US009702028B2

(12) United States Patent
Otsuka et al.

(10) Patent No.: US 9,702,028 B2
(45) **Date of Patent: *Jul. 11, 2017**

(54) MAGNESIUM-BASED ALLOY POWDER AND MAGNESIUM-BASED ALLOY MOLDED ARTICLE

(71) Applicant: Seiko Epson Corporation, Tokyo (JP)

(72) Inventors: Isamu Otsuka, Hachinohe (JP); Hiroyoshi Otaka, Hachinohe (JP)

(73) Assignee: Seiko Epson Corporation (JP)

( * ) Notice: Subject to any disclaimer, the term of this patent is extended or adjusted under 35 U.S.C. 154(b) by 74 days.

This patent is subject to a terminal disclaimer.

(21) Appl. No.: 14/191,823

(22) Filed: Feb. 27, 2014

(65) Prior Publication Data

US 2014/0238192 A1 Aug. 28, 2014

(30) Foreign Application Priority Data

Feb. 28, 2013 (JP) ..... 2013-038455

(51) Int. Cl.
*C22C 23/02* (2006.01)
*C22C 23/00* (2006.01)
(Continued)

(52) U.S. Cl.
CPC ..... *C22C 23/02* (2013.01); *B22F 3/20* (2013.01); *B22F 9/082* (2013.01); *C22C 1/0408* (2013.01);
(Continued)

(58) Field of Classification Search
CPC ..... C22C 23/00; C22C 23/02; C22C 1/0408; B22F 9/082; B22F 3/20
See application file for complete search history.

(56) References Cited

U.S. PATENT DOCUMENTS 2,159,964 A 5/1939 Burkhardt et al.
5,811,058 A 9/1998 Baba et al.
(Continued)

FOREIGN PATENT DOCUMENTS

GB 472771 * 5/1936
JP 09-041065 2/1997
(Continued)

OTHER PUBLICATIONS

Hiro et al., JP Pub. No. 2013-007068, published Jan. 2013 (machine translation).*
(Continued)

*Primary Examiner* — Jessee Roe
*Assistant Examiner* — John Hevey
(74) *Attorney, Agent, or Firm* — Harness, Dickey & Pierce, P.L.C.

(57) ABSTRACT

A magnesium-based alloy powder is made of a magnesium-based alloy that contains 0.2 mass % to 5 mass % of calcium, wherein the magnesium-based alloy powder has an average particle diameter of 100 μm to 1,500 μm, wherein the magnesium-based alloy powder has a particle average aspect ratio of 0.5 to 1, wherein the magnesium-based alloy powder has an apparent density of 0.2 g/cm$^3$ to 1.2 g/cm$^3$, and wherein the mean value of hardness variation index values obtained by dividing the difference of the maximum value and the minimum value of micro Vickers hardnesses taken at 10 measurement points in a particle cross section by the maximum value is 0.3 or less.

5 Claims, 1 Drawing Sheet

(51) Int. Cl.
*B22F 9/08* (2006.01)
*C22C 1/04* (2006.01)
*B22F 3/20* (2006.01)

(52) U.S. Cl.
CPC ..... *C22C 23/00* (2013.01); *B22F 2003/208* (2013.01); *B22F 2009/084* (2013.01); *B22F 2009/0824* (2013.01); *B22F 2009/0828* (2013.01); *B22F 2009/0832* (2013.01); *B22F 2009/0872* (2013.01); *B22F 2009/0888* (2013.01)

(56) References Cited

U.S. PATENT DOCUMENTS

| | | | | |
|---|---|---|---|---|
| 6,264,763 | B1 * | 7/2001 | Powell | C22C 23/02 148/420 |
| 2009/0263268 | A1 | 10/2009 | Kondoh et al. | |
| 2010/0116378 | A1 * | 5/2010 | Sugie | C22C 23/02 148/406 |
| 2011/0236250 | A1 | 9/2011 | Kim et al. | |
| 2011/0236251 | A1 | 9/2011 | Kim et al. | |
| 2012/0282131 | A1 | 11/2012 | Mizuno et al. | |
| 2013/0029886 | A1 | 1/2013 | Mazyar et al. | |
| 2013/0280121 | A1 | 10/2013 | Kim et al. | |
| 2014/0238191 | A1 * | 8/2014 | Otsuka | C22C 23/02 75/235 |

FOREIGN PATENT DOCUMENTS

| | | | | |
|---|---|---|---|---|
| JP | 09-291332 | | 11/1997 | |
| JP | 2006-348349 | A | 12/2006 | |
| JP | 2009-079271 | A | 4/2009 | |
| JP | 2010-082693 | A | 4/2010 | |
| JP | 2011-206847 | A | 10/2011 | |
| JP | 2013-007068 | * | 1/2013 | C22C 23/02 |
| WO | WO 2012/096432 | * | 7/2012 | C22C 23/02 |
| WO | WO-2012096432 | A1 | 7/2012 | |

OTHER PUBLICATIONS

Jones, T. et al., "Ballistic and Corrosion Analysis of New Military-Grade Magnesium Alloys AMX602 and ZAXE1711 for Armor Applications". Army Research Laboratory, Feb. 2012 (50 pages).

Jones, T. et al., "Initial Evaluation of Advanced Power Metallurgy Magnesium Alloys for Dynamic Applications". Magnesium Technology 2009 (pp. 185-189).

Kondoh, K. et al., "Microstructures and Mechanical Responses of Powder Metallurgy Noncombustive Magnesium Extruded Alloy by Rapid Solidification Process in Mass Production". Army Research Laboratory, May 2010 (18 pages).

Jones, T. et al., "The Development of Superior Magnesium Alloy AMX602 using a Novel Rapid Solidication Process for Structural Applications". Materials Science and Technology, 2010 ((pp. 2008-2019).

Kondoh, K. et al., "Microstructures and Mechanical Responses of Powder Metallurgy Non-combustive Magnesium Extruded Alloy by Rapid Solidification Process in Mass Production", Materials and Design, vol. 31, p. 1540-1546 (2010).

Kim, SM. et al., "Behaviour of CaO Coating of Gas Atomized Mg Powders Using Mechanical Milling Process", Journal of Alloys and Compounds, vol. 509S, p. S503-S506 (2011).

* cited by examiner

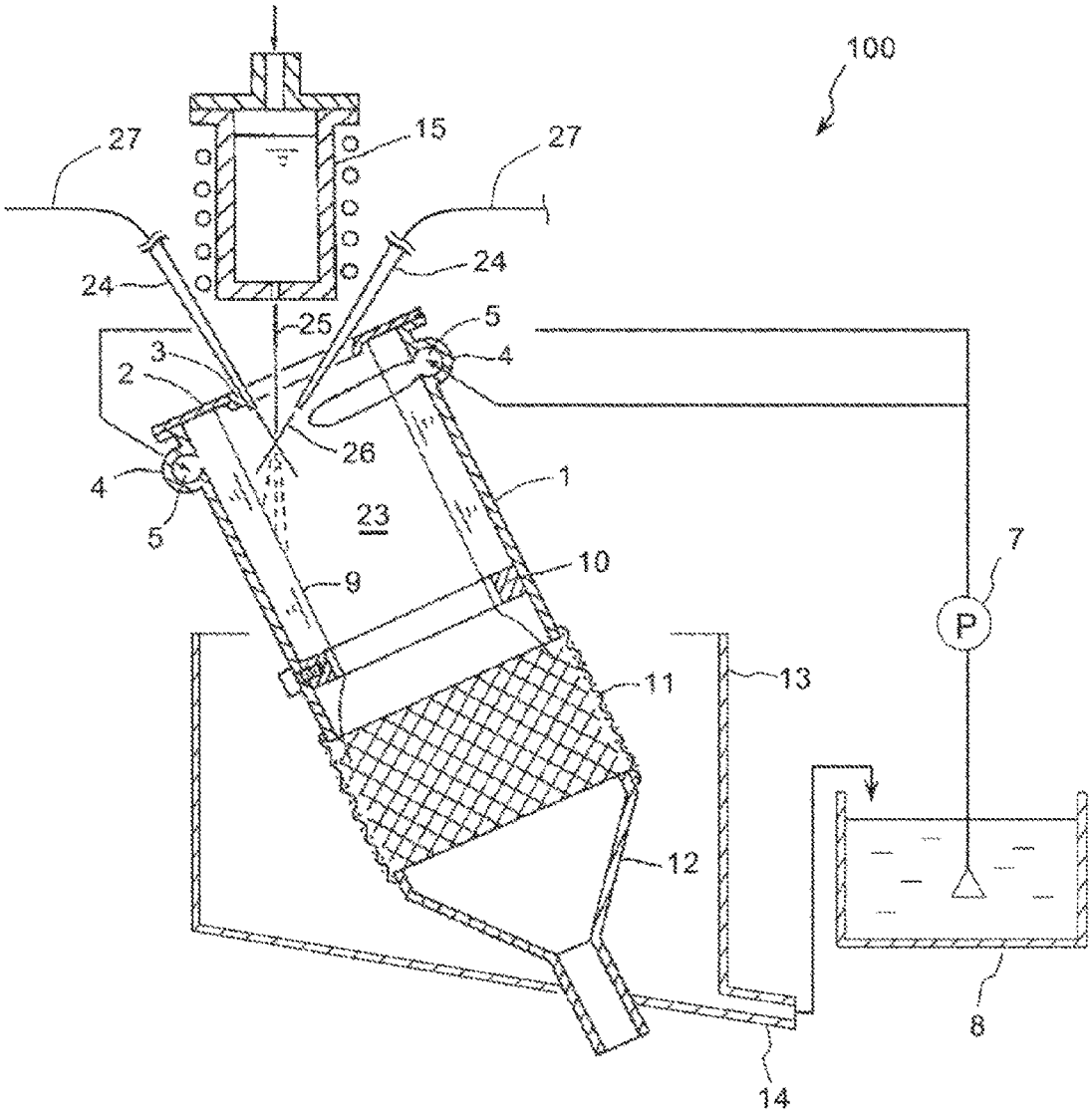
100
27
15
27
24
24
25
5
3
4
2
26
4
1
5
23
7
10
9
P
11
13
12
8
14

MAGNESIUM-BASED ALLOY POWDER AND MAGNESIUM-BASED ALLOY MOLDED ARTICLE

BACKGROUND

1. Technical Field

The present invention relates to a magnesium-based alloy powder, and a magnesium-based alloy molded article.

2. Related Art

Magnesium represents an abundant natural resource with its Clarke number (the proportion of elements present in the vicinity of the Earth's crust) at least 100-fold higher than that of nickel or copper. The specific gravity of magnesium is about ⅔ of that of aluminum, and about ¼ of that of iron. Structures produced from magnesium can thus be made much lighter than structures produced from these other metals. Over these backgrounds, magnesium alloy components have been used in a variety of products such as automobiles, aircraft, cell phones, and laptop personal computers.

Magnesium also has other desirable properties, including electromagnetic wave shielding performance, vibration damping capacity, ease of cutting, and biological safety.

Magnesium structure production employs various methods, including, for example, casting such as gravity casting, and die-casting, plasticization such as billet hot extrusion, cold extrusion, press-rolling, and forging, and powder metallurgy methods such as molding by hot pressing or hot extrusion of powder. The powder metallurgy methods can suppress local composition fluctuations, and can produce more homogeneous structures.

A problem of magnesium, however, is that it is highly flammable in the atmosphere. Magnesium powder, in particular, has the danger of causing the phenomenon called dust explosion by floating in air. This makes it practically impossible to simply replace common metallic materials and metal powders with magnesium, and prevented use of magnesium as structural material.

In view of these problems, magnesium has been studied for its flame retardance, and it has been found that adding calcium imparts flame retardance to magnesium. For example, JP-A-2010-82693 discloses a Mg alloy extruded material containing 4 to 8 mass % of calcium. Such flame-retardant magnesium has a firing temperature of 200° C. or higher than common magnesium, and improves not only the flame retardance of the structure itself, but the safety of structure production. The flame-retardant magnesium is thus expected to widen the use of magnesium structures.

The problem of the flame-retardant magnesium, however, is the poor mechanical strength. This has created the need to develop a material that can be used to produce a flame-retardant magnesium-based metal molded article of improved mechanical properties.

SUMMARY

An advantage of some aspects of the invention is to provide a magnesium-based alloy powder that can be used to produce a molded article having excellent molding compactability and high mechanical properties, and a magnesium-based alloy molded article of high mechanical properties produced from such a magnesium-based alloy powder.

An aspect of the invention is directed to a magnesium-based alloy powder that includes a magnesium-based alloy containing 0.2 mass % to 5 mass % of calcium, wherein the magnesium-based alloy powder has an average particle diameter of 100 μm to 1,500 μm, wherein the magnesium-based alloy powder has a particle average aspect ratio of 0.5 to 1, wherein the magnesium-based alloy powder has an apparent density of 0.2 g/cm$^3$ to 1.2 g/cm$^3$, and wherein the mean value of hardness variation index values obtained by dividing the difference of the maximum value and the minimum value of micro Vickers hardnesses taken at 10 measurement points in a particle cross section by the maximum value is 0.3 or less.

In this way, the powder can maintain excellent flame retardance, and can have excellent molding compactability. The magnesium-based alloy powder can thus be used to produce a molded article of high mechanical properties.

In the magnesium-based alloy powder of the aspect of the invention, it is preferable that the calcium segregates on a surface of each particle of the magnesium-based alloy powder.

This lessens the oxidation of magnesium in each particle, and the product molded article can be prevented from lowering its mechanical properties. Specifically, a molded article of excellent mechanical properties can be obtained. Further, the calcium tends to have a relatively more uniform distribution across the whole molded article produced by molding the magnesium-based alloy powder. It is therefore possible to provide more uniform flame retardance, and the bottom-up effect for flame retardance.

In the magnesium-based alloy powder of the aspect of the invention, it is preferable that the magnesium-based alloy further includes 2.5 mass % to 12 mass % of aluminum.

In this way, the intermetallic compound of calcium and aluminum precipitates, making it possible to increase the flame retardance of the magnesium-based alloy powder, and the heat resistance of the molded article.

In the magnesium-based alloy powder of the aspect of the invention, it is preferable that the average dendrite arm spacing (DAS) in a crystal structure of the magnesium-based alloy powder is 0.05 μm to 5 μm.

In this way, the balance between the crystal structure size and the percentage of the volume occupied by the magnesium-based alloy can be optimized. This makes it possible to suppress deformation due to the grain boundary glide while suppressing dislocation migration in the crystal structure, and to maintain the original mechanical properties of the magnesium-based alloy.

In the magnesium-based alloy powder of the aspect of the invention, it is preferable that the magnesium-based alloy powder is produced by using high-speed rotary water jet atomization.

In this way, the magnesium-based alloy powder can have a relatively large particle diameter, and a uniform particle size.

Another aspect of the invention is directed to a magnesium-based alloy molded article produced by using the magnesium-based alloy powder of the aspect of the invention.

In this way, the magnesium-based alloy molded article can have excellent flame retardance, and excellent mechanical properties.

In the magnesium-based alloy molded article of the aspect of the invention, it is preferable that the magnesium-based alloy molded article is produced through hot extrusion of the magnesium-based alloy powder.

In this way, the magnesium-based alloy molded article can have a uniform, fine crystal structure throughout the article.

BRIEF DESCRIPTION OF THE DRAWINGS

The invention will be described with reference to the accompanying drawing, wherein like numbers reference like elements.

The FIGURE is a longitudinal sectional view illustrating an example of an apparatus for producing a magnesium-based alloy powder by using high-speed rotary water jet atomization.

DESCRIPTION OF EXEMPLARY EMBODIMENTS

Preferred embodiments of a magnesium-based alloy powder, and a magnesium-based alloy molded article of the invention are described below with reference to the accompanying drawing.

Magnesium-Based Alloy Powder

The magnesium-based alloy powder of an embodiment of the invention is configured from a magnesium-based alloy containing 0.2 mass % to 5 mass % of calcium, and satisfies the conditions that the average particle diameter is 100 μm to 1,500 μm, the particle average aspect ratio is 0.5 to 1, the apparent density is 0.2 g/cm$^3$ to 1.2 g/cm$^3$, and the mean value of hardness variation index values obtained by dividing the difference of the maximum value and the minimum value of micro Vickers hardnesses taken at 10 measurement points in a particle cross section by the maximum value is 0.3 or less.

Such a magnesium-based alloy powder has excellent flame retardance, and excellent molding compactability that involves less segregation of intermetallic compounds. In this way, a molded article (magnesium-based alloy molded article) of excellent mechanical properties can be obtained.

The following more specifically describes the magnesium-based alloy powder.

The magnesium-based alloy forming the magnesium-based alloy powder contains magnesium as a main component, and 0.2 mass % to 5 mass % of calcium. The magnesium-based alloy containing calcium in such a proportion can have sufficient flame retardance without greatly lowering its mechanical properties. The calcium may be present in any state, for example, in the form of a simple substance, an oxide, or an intermetallic compound. Further, calcium may be uniformly dispersed (solid solution) in the alloy, or may be segregated at the crystal grain boundary.

When the calcium content is below the foregoing lower limit, sufficient flame retardance cannot be imparted to the magnesium-based alloy, and the product molded article suffers from poor flame retardance. On the other hand, when the calcium content exceeds the foregoing upper limit, the increased calcium proportion with respect to the magnesium lowers the mechanical properties of the product molded article.

The calcium content is preferably about 0.5 mass % to 4 mass %, more preferably about 0.8 mass % to 3.5 mass %.

The magnesium-based alloy may contain other components, other than magnesium and calcium. Examples of such other components include lithium, beryllium, aluminum, silicon, manganese, iron, nickel, copper, zinc, strontium, yttrium, zirconium, silver, tin, gold, and rare earth elements (for example, cerium). One or more of these may be added.

Particularly preferred as the additional component is at least one selected from the group consisting of aluminum, manganese, yttrium, strontium, and a rare earth element.

The content of the additional component is preferably about 0.01 mass % to 10 mass %, more preferably about 0.1 mass % to 5 mass %.

The magnesium, typically present in the state of a simple substance, may partially exist in the state of, for example, an oxide or an intermetallic compound.

The average particle diameter of the magnesium-based alloy powder may be 100 μm to 1,500 μm, preferably 300 μm to 1,300 μm, more preferably 500 μm to 1,100 μm. In these average particle diameter ranges, it is possible to suppress aggregation often seen in fine powders (aggregation attributed to powder shape), and improve packing ability for the molding. The size of crystal grains formed in a molded article also can be reduced. This is probably because the temperature increase of the heated particles proceeds relatively more uniformly with the average particle diameter falling in the foregoing ranges, preventing local enlargement of crystal grain size, and narrowing the size distribution of the crystal grains. This improves the molding compactability, and a molded article of excellent mechanical properties can be obtained.

It is also possible to disperse the calcium relatively uniformly, and a highly flame-retardant molded article can be obtained. This is because, with the average particle diameter falling in the foregoing ranges, the calcium-containing intermetallic compound tends to have a uniform distribution in the molded articles even when the intermetallic compound precipitates, and provides uniform flame retardance. The uniform flame retardance involves fewer low-flame-retardance locations, and improves the overall flame retardance. Further, with the uniform intermetallic compound distribution, the localized decrease of mechanical strength due to segregation of the intermetallic compound can be prevented, and a molded article of excellent mechanical properties can be obtained.

Further, because the particles can have relatively small surface areas, formation of oxide precipitates in the molded article can be relatively suppressed. This further improves the mechanical properties of the product molded article.

The average particle diameter of the magnesium-based alloy powder is the mean diameter of circles having the same area as the particle image (particle projection area) observed with a light microscope, an electron microscope, or the like. The mean value is calculated from at least 100 randomly selected particles.

When the average particle diameter is below the foregoing lower limits, the aggregability of the magnesium-based alloy powder increases, and the molding compactability suffers. On the other hand, an average particle diameter above the foregoing upper limits lowers the packing ability of the powder, and the molding compactability.

The maximum particle diameter of the magnesium-based alloy powder is preferably 4,000 μm or less, more preferably 3,000 μm or less. With the maximum particle diameter falling in these ranges, an appropriate particle size distribution can be obtained, and packing ability can be improved for the molding. Specifically, the temperature increase of the heated particles proceeds more uniformly with the maximum particle diameter falling in the foregoing ranges. This prevents local enlargement of crystal grain size, and further narrows the size distribution of the crystal grains.

As used herein, "maximum particle diameter" means the maximum particle diameter of at least 100 randomly selected particles.

The average particle diameter is preferably 0.1 to 0.7 times, more preferably 0.15 to 0.6 times, further preferably 0.2 to 0.5 times the maximum particle diameter. With the average particle diameter and the maximum particle diameter satisfying these relationships, the molding compactability can be particularly improved, and a molded article of even superior mechanical properties can be obtained.

The average degree of circularity of the magnesium-based alloy powder is preferably 0.5 to 1, more preferably 0.6 to 1. The magnesium-based alloy powder with these average degrees of circularity can have excellent fluidity, and improved packing ability for the molding. This makes it possible to improve the molding compactability, and obtain a molded article of excellent mechanical properties.

The average degree of circularity of the magnesium-based alloy powder is the mean value of the degrees of circularity calculated as the ratio of the circumference of a circle having the same area as the particle projection area to the length of the contour of a particle image observed with a light microscope, an electron microscope, or the like. The mean value is calculated from at least 100 randomly selected particles.

The average aspect ratio of the magnesium-based alloy powder is preferably 0.5 to 1, more preferably 0.6 to 0.9. The magnesium-based alloy powder with these average aspect ratios can have excellent fluidity, and improved packing ability for the molding. This makes it possible to improve the molding compactability, and obtain a molded article of excellent mechanical properties.

The average aspect ratio of the magnesium-based alloy powder is the mean value of the aspect ratios calculated as the minor axis/major axis ratios in a particle image observed with a light microscope, an electron microscope, or the like. The mean value is calculated from at least 100 randomly selected particles. The major axis is the maximum length observed in the particle image, and the minor axis is the maximum length orthogonal to the maximum length of the major axis.

When the average aspect ratio is above the foregoing upper limits, the packing ability of the powder, and the molding compactability suffer. On the other hand, an average aspect ratio below the foregoing lower limits lowers the molding shape retention, and the dimensional accuracy of the product molded article.

The apparent density of the magnesium-based alloy powder may be 0.2 g/cm$^3$ to 1.2 g/cm$^3$, and is preferably 0.3 g/cm$^3$ to 0.8 g/cm$^3$. With the apparent density falling in these ranges, the molding compactability of the magnesium-based alloy powder can be particularly improved.

The apparent density is also called bulk specific gravity, and is determined by measuring the amount of powder that can fill a container of a certain volume when the powder is charged into the container under certain conditions, and by calculating the mass per unit volume. The measurement may be performed according to, for example, the method specified by JIS Z 2504.

When the apparent density is below the foregoing lower limits, the packing ability of the powder, and the molding compactability suffer. On the other hand, an apparent density above the foregoing upper limits improves the packing ability of the powder, but lowers fluidity, with the result that the molding compactability suffers.

The magnesium-based alloy powder of the embodiment of the invention has a hardness variation index mean value of 0.3 or less. The hardness variation index is calculated by measuring micro Vickers hardness at 10 measurement points equally spaced apart in a particle cross section, and dividing the difference of the maximum value and the minimum value of these 10 points by the maximum value. In this way, the magnesium-based alloy powder can have a sufficiently uniform crystal structure in single particles. This makes it possible to produce a molded particle that hardly contains enlarged crystal structures, and that has particularly high mechanical properties. A powder with locations of low hardness may cause destruction from these locations in the product molded article, and lower the overall mechanical properties of the molded article. The present inventors found that progression of such destruction can be reliably suppressed when the micro Vickers hardness variation in a particle cross section is kept in the foregoing range, even when the powder includes locations at which destruction may occur.

The micro Vickers hardness is the value measured at evenly distributed 10 points in a cross section of a single particle with a micro Vickers hardness meter. The hardness variation index is determined from the measured values of these 10 points. The hardness variation index is calculated for at least 50 particles, and the mean value is confined within the range of 0.3 or less. In the measurement, a load of 25 gf (0.245 N) is applied to the indenter. For the calculation of hardness variation index, the maximum length L of a particle cross section is measured, and at least 50 particles randomly selected from particles having maximum lengths L within ±20% of the average particle diameter are used to determine the hardness variation index. The ten measurement points in a cross section of a single particle are selected as follows. First, the hardness is measured for a randomly selected point in a particle cross section, and a second measurement point is selected that is distant apart from the first measurement point by a distance of 5% or more of the maximum length L. This is repeated until ten measurement points are selected. For example, in the case of a particle with a maximum length L of 100 μm, first and second measurement points are selected that are distant apart from each other by a distance of 5 μm or more, and the subsequent points are selected in the same manner by leaving a distance of at least 5 μm from the preceding points.

The mean value of hardness variation index is preferably 0.2 or less, more preferably 0.15 or less.

As described above, the magnesium-based alloy powder of the embodiment of the invention is configured from a magnesium-based alloy that contains 0.2 mass % to 5 mass % of calcium, and satisfies the conditions that the average particle diameter is 100 μm to 1,500 μm, the particle average aspect ratio is 0.5 to 1, the apparent density is 0.2 g/cm$^3$ to 1.2 g/cm$^3$, and the mean value of hardness variation index is 0.3 or less. In this way, the magnesium-based alloy powder can have a hardness distribution suited for molding while maintaining excellent flame retardance. The magnesium-based alloy powder of the embodiment of the invention can thus be used to provide a molded article (magnesium-based alloy molded article) having excellent molding compactability, and excellent mechanical properties.

It is preferable in the magnesium-based alloy powder of the embodiment of the invention that the calcium segregates on the surface of each particle. This lessens the oxidation of magnesium in each particle, and the product molded article can be prevented from lowering its mechanical properties. Specifically, a molded article of excellent mechanical properties can be obtained with the calcium segregated on particle surface. Further, the calcium, by segregating on particle surface, tends to have a relatively more uniform distribution across the whole molded article produced by molding the magnesium-based alloy powder. It is therefore possible to provide more uniform flame retardance, and the bottom-up effect for flame retardance.

The calcium segregated on particle surface may exist in the state of, for example, a simple substance, an oxide, or an intermetallic compound. As used herein, "segregate" is not intended to mean that calcium does not exist inside the particle, but the term refers to the state where the calcium concentration is higher on particle surface than inside the particle. The calcium concentration measurement may be performed by using, for example, optical emission spectroscopy (OES), X-ray photoelectron spectroscopy (XPS), secondary ion mass spectrometry (SIMS), electron probe microanalysis (EPMA), Auger electron spectroscopy (AES), or Rutherford backscattering spectrometry (RBS).

Specifically, the calcium concentration on particle surface is preferably 2 times or more, more preferably about 3 to 1,000 times, further preferably about 5 to 800 times the calcium concentration inside the particle in terms of a mass ratio. With these calcium concentration differences, excellent flame retardance and excellent post-mold mechanical properties can be realized at the same time at high level.

Preferably, calcium coexists with magnesium oxide on particle surface. The magnesium oxide can shield more oxygen, and the magnesium inside the particle does not easily oxidize. Increase of the oxygen content in the particle as a whole, and decrease of mechanical properties in the product molded article can thus be suppressed.

It is also preferable that calcium oxide and magnesium oxide coexist on particle surface. This further lessens the oxidation of the magnesium inside the particle, and the surface with the segregation of calcium does not easily detach itself from the inner side. This makes it possible to more stably maintain the effect of suppressing oxidation inside the particle.

As used herein, "particle surface" refers to a region down to 100 nm from the particle surface.

In an X-ray diffraction crystal structure analysis of the magnesium-based alloy powder, the highest peak intensity derived from magnesium oxide is preferably 5% to 45%, more preferably 7% to 40% of the highest peak intensity derived from the simple substance magnesium in an X-ray diffraction spectrum. With the magnesium oxide contained in certain proportions with respect to the simple substance magnesium, the magnesium-based alloy powder can further improve the molding mechanical properties while maintaining flame retardance. This is believed to be due to the optimized magnesium oxide content further suppressing oxidation inside the particle.

The magnesium-based alloy may contain other components, in addition to magnesium and calcium, as noted above. Preferably, the magnesium-based alloy contains 2.5 mass % to 12 mass % of aluminum as such additional component. Adding aluminum in these proportions precipitates an intermetallic compound of calcium and aluminum. The intermetallic compound has a high melting point, and can particularly improve the flame retardance of the magnesium-based alloy powder, and the heat resistance of the molded article. Note, however, because of the low solid solubility of the intermetallic compound for the matrix, the aluminum may lower the ductility or other mechanical properties of the molded article. For this reason, the aluminum, when added, is added in the foregoing ranges to minimize the extent of decrease of the mechanical properties, and provide sufficient flame retardance for the magnesium-based alloy powder, and sufficient heat resistance for the molded article.

The aluminum content is more preferably 3 mass % to 11 mass %, further preferably 4 mass % to 10 mass %.

In an X-ray diffraction crystal structure analysis of the magnesium-based alloy powder, the highest peak intensity derived from the intermetallic compound of calcium and aluminum is preferably 3% to 40%, more preferably 4% to 35%, further preferably 5% to 30% of the highest peak intensity derived from the simple substance magnesium in an X-ray diffraction spectrum. With the intermetallic compound contained in certain proportions with respect to the simple substance magnesium, the magnesium-based alloy powder can further improve the molding mechanical properties while maintaining flame retardance. Though the reason for this effect remains unclear, one possible explanation is the pinning effect (the effect of suppressing the motion of dislocation due to deformation) of the intermetallic compound improving the mechanical properties.

Examples of the intermetallic compound include AlCa, and $Al_2Ca$.

The presence of the intermetallic compound may be confirmed by, for example, observing a particle cross section of the magnesium-based alloy powder with a scanning electron microscope or the like. Specifically, the observed particles of intermetallic compound preferably exist in the state of being dispersed in the magnesium matrix, and the particle average particle diameter is preferably about 50 nm to 500 nm, more preferably about 100 nm to 300 nm.

In an X-ray diffraction spectrum of the magnesium-based alloy powder, the highest peak intensity derived from the magnesium oxide is preferably smaller than the highest peak intensity derived from the intermetallic compound of calcium and aluminum. Specifically, when the peak intensity of the latter is 1, the peak intensity of the former is preferably 0.01 to 0.5, more preferably 0.02 to 0.4. In this way, the molding mechanical properties can be particularly improved through the effect of the magnesium oxide suppressing oxidation inside the particles and improving compactability, combined with the pinning effect of the intermetallic compound.

The average dendrite arm spacing (DAS) of the crystal structure in the magnesium-based alloy powder particle is preferably 0.05 μm to 5 μm, more preferably 0.3 μm to 4 μm, further preferably 0.5 μm to 3.5 μm. With the average DAS of the crystal structure confined in these ranges, a molded article of particularly improved mechanical properties can be obtained.

Specifically, when the average DAS of the crystal structure is below the foregoing lower limits, the volume occupied by grain boundary becomes excessive, and makes the magnesium-based alloy volume relatively smaller. In this case, the intended mechanical properties of the magnesium-based alloy may not be obtained, as determined by the composition of the magnesium-based alloy. On the other hand, when the average DAS of the crystal structure is above the foregoing upper limits, dislocation migration (glide deformation) tends to occur more easily in the crystal structure, and the intended mechanical properties of the magnesium-based alloy may not be obtained, as determined by the composition of the magnesium-based alloy.

The DAS measurement may be performed, for example, according to the procedures described in Procedures of Dendrite Arm Spacing Measurement (The Japan Institute of Light Metals, Committee of Casting and Solidification). At least 100 randomly selected particles are used for the calculation of mean value. The arm spacing is determined for dendrites observed at a central portion of a particle cross section, and the average is calculated as the average DAS.

Similarly, in DAS measurements taken at 10 measurement points in a particle cross section, the difference between the maximum value and the minimum value is preferably 30% or less, more preferably 20% or less, further preferably 15% or less of the maximum value. In this way, the product molded article can have a uniform crystal structure, and particularly high mechanical properties.

The magnesium-based alloy powder of the embodiment of the invention may be produced by using any method. Examples of production methods include various powderization methods, including, for example, atomization (for example, such as water atomization, gas atomization, and high-speed rotary water jet atomization), a reduction method, a carbonyl method, and pulverization. The magnesium-based alloy powder is produced preferably by atomization, more preferably high-speed rotary water jet atomization. By using these methods, the magnesium-based alloy powder can have a relatively larger particle diameter, and more uniform particle size compared to those produced by other powderization methods. The powder can thus have high fluidity, and excellent packing ability for the molding. Further, less magnesium oxide can be used for the powder as a whole. Further, because the molten-state raw material can be rapidly cooled in a very short time period, each particle can have a prominently fine crystal structure. The resulting powder can thus be used to produce a molded article of excellent mechanical properties.

In the high-speed rotary water jet atomization, a coolant is supplied by being ejected onto along the inner periphery of a cooling cylinder, and spun along the inner periphery of the cooling cylinder to form a coolant layer on the inner periphery. Separately, a raw material of the magnesium-based alloy is melted, and the resulting molten metal (hot metal) is allowed to free fall while a liquid or gas jet is ejected onto the falling molten metal. The molten metal scatters under the force of the jet, and is incorporated into the coolant layer. The scattered fine powder of the molten metal rapidly cools and solidifies into the magnesium-based alloy powder.

The FIGURE is a longitudinal sectional view illustrating an example of an apparatus used to produce the magnesium-based alloy powder by using high-speed rotary water jet atomization.

As illustrated in the FIGURE, a powder producing apparatus 100 includes a cooling cylinder 1 used to form a coolant layer 9 on its inner periphery, a crucible 15 provided as a supply container that supplies a stream of a molten metal 25 down into a space 23 inside the coolant layer 9, a pump 7 that supplies a coolant to the cooling cylinder 1, and jet nozzles 24 that eject a liquid jet 26, and separate the falling narrow stream of the molten metal 25 into droplets with the liquid jet 26 to supply the droplets to the coolant layer 9.

The cooling cylinder 1 is cylindrical in shape, and installed in such a manner that the cylinder axis line orients itself along the vertical direction, or is tilted 30° or less with respect to the vertical direction. The FIGURE shows the state where the cylinder axis line is tilted with respect to the vertical direction. The upper opening of the cooling cylinder 1 is closed with a lid 2. The lid 2 has an opening 3 through which a falling stream of the molten metal 25 is supplied into the space 23 of the cooling cylinder 1.

On an upper portion of the cooling cylinder 1 is provided a coolant ejection tube 4 configured to eject and supply the coolant in direction tangent to the inner periphery of the cooling cylinder 1. The coolant ejection tube 4 has a plurality of discharge openings 5 disposed at regular intervals along the circumferential direction of the cooling cylinder 1. The axial direction of the coolant ejection tube 4 is tilted 0° to 20° downward from a plane that is orthogonal to the axis line of the cooling cylinder 1.

The coolant ejection tube 4 is connected by a pipe to a tank 8 via the pump 7, so that the coolant inside the tank 8 is sucked through the pump 7 into the coolant ejection tube 4, which then ejects and supplies the coolant into the cooling cylinder 1. The coolant gradually flows down as it is spun along the inner periphery of the cooling cylinder 1, and forms a layer (coolant layer 9) along the inner periphery. A radiator may be disposed in the tank 8 or in the circulation channel, as required. The coolant may be water, or an oil (such as a silicone oil), and may contain various additives. Oxidation due to the cooling of the powder can be suppressed by removing the dissolved oxygen in the coolant beforehand.

A thickness adjusting ring 10 that adjusts the thickness of the coolant layer 9 is detachably provided on a lower portion of the inner periphery of the cooling cylinder 1. By the provision of the thickness adjusting ring 10, the coolant flow rate can be suppressed to provide thickness for the coolant layer 9, and to obtain a uniform thickness.

A cylindrical liquid-draining screen unit 11 is provided further down the cooling cylinder 1, and a funnel-like powder collecting container 12 is provided on the lower side of the liquid-draining screen unit 11. Around the liquid-draining screen unit 11 is a coolant collecting cover 13 surrounding the liquid-draining screen unit 11. The coolant collecting cover 13 has a drain opening 14 at the bottom. The drain opening 14 is connected to the tank 8 via a pipe.

The jet nozzles 24 that eject air, inert gas, or the like extend into the space 23. The jet nozzles 24 are attached to the tip of gas supply tubes 27, and are inserted through the opening 3 of the lid 2, and are disposed to orient the ejection holes toward the narrow stream of the molten metal 25, and the coolant layer 9.

For production of the magnesium-based alloy powder with the powder producing apparatus 100, the pump 7 is activated to form the coolant layer 9 on the inner periphery of the cooling cylinder 1, and the molten metal 25 in the crucible 15 is flown down into the space 23. Ejecting the liquid jet 26 onto the molten metal 25 scatters the molten metal 25, and the resulting fine powder of the molten metal 25 is trapped into the coolant layer 9, upon which the fine powder of the molten metal 25 cools and solidifies into the magnesium-based alloy powder.

In the high-speed rotary water jet atomization, the coolant is continuously supplied, and the coolant layer 9 can stably maintain certain conditions. This stabilizes the particle size, the aspect ratio, the crystal structure, and other properties of the product magnesium-based alloy powder, and improves the production efficiency of the magnesium-based alloy powder of the embodiment of the invention.

The properties of the magnesium-based alloy powder, including, for example, particle size, aspect ratio, apparent density, the DAS of crystal structure, micro Vickers hardness, and the degree of circularity can be controlled by adjusting the producing conditions. For example, the DAS of crystal structure can be decreased, and the micro Vickers hardness can be increased by increasing the cooling rate even when the powder has a large particle size, and the DAS and the micro Vickers hardness can have less variation in single particles. Further, the particle size of the magnesium-based alloy powder can be further reduced by increasing the ejection pressure of the coolant.

More specifically, the ejection pressure of the coolant supplied into the cooling cylinder 1 is preferably about 50 MPa to 200 MPa, and the liquid temperature is preferably about −10° C. to 40° C. This optimizes the flow rate of the coolant layer 9, and the fine powder of the molten metal 25 can sufficiently cool in a uniform fashion. When the coolant pressure is below the foregoing lower limit, or when the liquid temperature is above the foregoing upper limit, the cooling capacity may become insufficient, and enlargement may occur in the crystal structure of large particles. On the other hand, when the coolant pressure is above the foregoing upper limit, the fine powder of the molten metal 25 may elongate under the force of the stream of the coolant, and form irregular particle shapes. When the liquid temperature is below the foregoing lower limit, it becomes difficult to maintain liquid temperature, and the liquid temperature may increase over time. This may cause variation in the properties of the product magnesium-based alloy powder.

When melting the raw material of the magnesium-based alloy, the melt temperature is preferably about Tm+20° C. to Tm+200° C., more preferably about Tm+50° C. to Tm+150° C., where Tm is the melting point of the magnesium-based alloy. In this way, the variation of particle properties can be particularly suppressed when the fine powder of the molten metal 25 is produced with the liquid jet 26, and the resulting particles can have parameters, such as particle size, aspect ratio, apparent density, and hardness, all falling in the foregoing ranges.

The particle size of the magnesium-based alloy powder can be controlled by adjusting the ejection pressure of the liquid jet 26 ejected through the jet nozzles 24. For example, the particle size of the magnesium-based alloy powder can be further reduced by increasing the ejection pressure of the liquid jet 26.

The jet nozzles 24 are optional, and may be omitted. When the jet nozzles 24 are not provided, the cooling cylinder 1 is installed with its axis line tiled with respect to vertical direction, and a narrow stream of the molten metal 25 is directly flown down into the coolant layer 9. The flow of the coolant layer 9 powderizes the molten metal 25 into a fine powder, and cools and solidifies the molten metal 25 to form a magnesium-based alloy powder of a relatively large particle diameter. This method provides a very wide cooling zone per unit time, and is particularly useful for making a finer and more uniform crystal structure.

Magnesium-Based Alloy Molded Article

The magnesium-based alloy molded article of an embodiment of the invention may be produced by molding and calcining, or hot extrusion of the magnesium-based alloy powder of the embodiment of the invention. The molding and calcining may be by sintering methods such as hot-press sintering, hot isostatic press (HIP) sintering, pulse electric current sintering, and pressureless sintering using an electric furnace or a gas furnace.

In the hot-press, the magnesium-based alloy powder is charged into a mold, and heated under applied pressure to obtain a magnesium-based alloy molded article (sintered body). Here, by applying pressure and heat under reduced pressure atmosphere and inert gas atmosphere, the oxidation of the magnesium-based alloy can be suppressed, and a magnesium-based alloy molded article of low magnesium oxide content can be obtained. The reduced pressure is not particularly limited, and is about 95 kPa or less, preferably about 0.1 kPa to 90 kPa.

The molding temperature of the hot-press may be appropriately selected according to such factors as the composition and the particle size of the magnesium-based alloy powder, and the shape of the molded article, and is, for example, preferably 100° C. to 800° C., more preferably 200° C. to 700° C.

Likewise, the molding pressure of the hot-press may be appropriately selected according to such factors as the composition and the particle size of the magnesium-based alloy powder, and the shape of the molded article, and is, for example, preferably 300 MPa to 1,500 MPa, more preferably 400 MPa to 1,100 MPa.

In the hot extrusion, the powder or green compact (billet) is extruded under heat to obtain a magnesium-based alloy molded article. The magnesium-based alloy molded article produced by hot extrusion can have improved uniformity during the production, and have a uniform size distribution of crystal structures throughout the article. This is because the hot extrusion applies shear stress to the powder, and can produce finer crystal structures even when relatively large crystal structures are contained. The crystal structures can thus have a uniform size throughout the article. The method is also useful because it allows a molded article of a complex shape or a hollow shape to be efficiently produced by simply selecting an appropriate dice shape.

The extrusion temperature of the hot extrusion may be appropriately selected according to such factors as the composition and the particle size of the magnesium-based alloy powder, and the shape of the molded article, and is, for example, preferably 250° C. to 500° C., more preferably 300° C. to 450° C.

Likewise, the extrusion pressure of the hot extrusion may be appropriately selected according to such factors as the composition and the particle size of the magnesium-based alloy powder, and the shape of the molded article, and is, for example, preferably 300 MPa to 1,000 MPa, more preferably 400 MPa to 800 MPa.

The magnesium-based alloy molded article may be used for any purpose, including, for example, transportation device components such as automobile components, train components, ship components, and aircraft components; electronic device components such as personal computer components, and cell phone components; and structures such as ornaments, artificial bones, and artificial dental roots.

The invention is not limited to the foregoing descriptions of the preferred embodiments of the magnesium-based alloy powder and the magnesium-based alloy molded article. For example, a coating may be formed on the particle surface of the powder of the embodiment above.

EXAMPLES

Specific examples of the invention are described below.

1. Production of Magnesium-based Alloy Molded Article Sample No. 1

1. First, the raw material was melted with a high-frequency induction furnace, and powderized by high-speed rotary water jet atomization to obtain a magnesium-based alloy powder. The alloy composition of the magnesium-based alloy powder is as follows.

Al: 5.699 mass %, Zn: 0.057 mass %, Mn: 0.271 mass %, Fe: 0.002 mass %, Si: 0.025 mass %, Cu: 0.005 mass %, Ni: 0.002 mass %, Ca: 1.880 mass %, Mg: reminder The high-speed rotary water jet atomizer (powder producing apparatus) had the following settings.

Coolant ejection pressure: 100 MPa

Coolant temperature: 30° C.

Molten metal temperature: Tm+20° C.

2. Some of the magnesium-based alloy powder was press molded (hot press) into a cylindrical shape to obtain a green compact (billet). The molding was performed at a temperature of 300° C. under 350 MPa pressure in a reduced-pressure atmosphere.

3. The green compact was subjected to hot extrusion to obtain a magnesium-based alloy molded article. The extrusion was performed at a temperature of 300° C. under 700 MPa pressure.

4. The resulting magnesium-based alloy powder was then observed with a scanning electron microscope. The diameter of a circle having the same area as the observed particle image was calculated. The calculation was made for 100 particles, and the results were averaged to obtain an average particle diameter of the magnesium-based alloy powder. The maximum value in the particle size data of the 100 particles was recorded as a maximum particle diameter.

5. For the observed particle image, an aspect ratio as the minor axis/major axis ratio was determined. The aspect ratio was calculated for 100 particles, and the results were averaged to obtain an average aspect ratio of the magnesium-based alloy powder.

6. The magnesium-based alloy powder was also measured for apparent density according to the method specified by JIS Z 2504.

7. The magnesium-based alloy powder was measured for hardness at 10 measurement points on a cross sectional surface exposed by cutting the particle, using a micro Vickers hardness meter. After finding the maximum value and the minimum value of the measured values at these 10 points, the difference between these maximum and minimum value was calculated, and the ratio of the difference with respect to the maximum value was determined (hardness variation index). The calculation was performed for 100 particles, and the mean value was determined. In the measurement, a load of 25 gf (0.245 N) was applied to the indenter.

8. The particle cross section of the magnesium-based alloy powder was observed with an electron microscope, and dendrite arm spacing (DAS) was determined for dendrites observed at a central portion of the cross section. The DAS was calculated for 100 particles, and the results were averaged to obtain an average DAS of the magnesium-based alloy powder. The DAS measurement was performed according to the procedures described in Procedures of Dendrite Arm Spacing Measurement (The Japan Institute of Light Metals, Committee of Casting and Solidification). Table 1 presents the results of these measurements and calculations, specifically average particle diameter, average aspect ratio, apparent density, the mean value of hardness variation index, and average DAS.

Sample Nos. 2 to 4, and 9 to 11

Magnesium-based alloy molded articles were obtained in the same manner as for sample No. 1, except that the magnesium-based alloy powders had the properties shown in Table 1.

The high-speed rotary water jet atomizer was used in different settings, as follows. The ejection pressure of the liquid jet ejected through the jet nozzles was also changed for each sample to produce powders of different average particle diameters.

Coolant ejection pressure: 150 MPa

Coolant temperature: 10° C.

Molten metal temperature: Tm+100° C.

Sample Nos. 5 to 8

Magnesium-based alloy molded articles were obtained in the same manner as for sample No. 1, except that the magnesium-based alloy powders had the properties shown in Table 1.

The high-speed rotary water jet atomizer was used in different settings, as follows. The ejection pressure of the coolant was also changed for each sample to produce powders of different average particle diameters. Note that the high-speed rotary water jet atomizer was used without the jet nozzles.

Coolant ejection pressure: 120 MPa to 200 MPa

Coolant temperature: 20° C.

Molten metal temperature: Tm+150° C.

Sample Nos. 12, 13, 14, and 15

Magnesium-based alloy molded articles were obtained in the same manner as for sample Nos. 1, 4, 5, 8, except that the magnesium-based alloy had the following composition.

Al: 6.161 mass %, Zn: 0.074 mass %, Mn: 0.228 mass %, Fe: 0.006 mass %, Si: 0.003 mass %, Cu: 0.001 mass %, Ni: 0.002 mass %, Ca: 2.020 mass %, Mg: reminder Sample Nos. 16 and 17

Magnesium-based alloy molded articles were obtained in the same manner as for sample Nos. 4 and 5, except that the magnesium-based alloy had the following composition.

Al: 6.810 mass %, Zn: 0.964 mass %, Mn: 0.011 mass %, Fe: 0.008 mass %, Ca: 1.031 mass %, La: 2.961 mass %, Mg: reminder Sample No. 18

A magnesium-based alloy molded article was obtained in the same manner as for sample No. 1, except that the molded article was obtained by using a cast extrusion method, instead of the hot-press and hot working.

In Table 1, the magnesium-based alloy powders and the magnesium-based alloy molded articles of the samples are listed under the headings "Example" (the invention) and "Comparative Examples" (outside of the invention).

2. Evaluation of Magnesium-based Alloy Powder 2.1. Element Distribution of Magnesium-based Alloy Powder The magnesium-based alloy powder of each sample was analyzed by the elemental analysis of a cross section using electron probe microanalysis. Calcium concentrations were measured on particle surface and inside the particle, and the ratio of these concentrations was calculated as a factor. The results are presented in Table 1.

2.2. Crystal Structure Analysis of Magnesium-based Alloy Powder

The crystal structure of the magnesium-based alloy powder of each sample was analyzed by X-ray diffraction. The proportion of the highest peak intensity derived from magnesium oxide (MgO) with respect to the highest peak intensity derived from the simple substance magnesium was then calculated from the resulting X-ray diffraction spectrum. The proportion of the highest peak intensity derived from the intermetallic compound of aluminum and calcium with respect to the highest peak intensity derived from the simple substance magnesium was also calculated from the X-ray diffraction spectrum. The calculation results are presented in Table 1.

3. Evaluation of Magnesium-based Alloy Molded Article 3.1. Tensile Strength of Magnesium-based Alloy Molded Article The magnesium-based alloy molded article of each sample was measured for tensile strength according to the method specified by JIS Z 2241. The measured values were used to determine relative values with respect to the tensile strength, 1, of the magnesium-based alloy molded article of sample No. 18. The results are presented in Table 1.

3.2. 0.2% Bearing Force of Magnesium-based Alloy Molded Article

The magnesium-based alloy molded article of each sample was measured for 0.2% bearing force according to the method specified by JIS Z 2241. The measured values were used to determine relative values with respect to the 0.2% bearing force, 1, of the magnesium-based alloy molded article of sample No. 18. The results are presented in Table 1.

3.3. Elongation of Magnesium-based Alloy Molded Article

The magnesium-based alloy molded article of each sample was measured for elongation (%) according to the method specified by JIS Z 2241. The measured values were used to determine relative values with respect to the elongation (%), 1, of the magnesium-based alloy molded article of sample No. 18. The results are presented in Table 1 along with other evaluation results.

TABLE 1

| | | | Powder properties | | | | | | |
|---|---|---|---|---|---|---|---|---|---|
| | | Method of production of molded article | Average particle diameter μm | Maximum particle diameter μm | Average particle diameter/ maximum particle diameter — | Average aspect ratio — | Apparent density g/cm$^3$ | Mean value of hardness variation index — | Average DAS μm |
| Sample No. 1 | Comparative Example | Powder hot extrusion | 326 | 1654 | 0.20 | 0.45 | 0.28 | 0.35 | 3.4 |
| Sample No. 2 | Example | Powder hot extrusion | 487 | 1987 | 0.25 | 0.56 | 0.58 | 0.28 | 2.1 |
| Sample No. 3 | Example | Powder hot extrusion | 684 | 2147 | 0.32 | 0.63 | 0.65 | 0.21 | 1.6 |
| Sample No. 4 | Example | Powder hot extrusion | 867 | 2315 | 0.37 | 0.71 | 0.74 | 0.18 | 0.9 |
| Sample No. 5 | Example | Powder hot extrusion | 1104 | 2650 | 0.42 | 0.77 | 0.87 | 0.15 | 0.8 |
| Sample No. 6 | Example | Powder hot extrusion | 1242 | 3184 | 0.39 | 0.59 | 0.66 | 0.13 | 1.1 |
| Sample No. 7 | Example | Powder hot extrusion | 1368 | 3268 | 0.42 | 0.53 | 0.47 | 0.11 | 1.8 |
| Sample No. 8 | Comparative Example | Powder hot extrusion | 1587 | 4586 | 0.35 | 0.50 | 0.17 | 0.41 | 4.6 |
| Sample No. 9 | Comparative Example | Powder hot extrusion | 1004 | 3211 | 0.31 | 0.83 | 1.23 | 0.68 | 5.0 |
| Sample No. 10 | Comparative Example | Powder hot extrusion | 85 | 845 | 0.10 | 0.67 | 0.21 | 0.10 | 0.2 |
| Sample No. 11 | Comparative Example | Powder hot extrusion | 1487 | 4156 | 0.36 | 0.56 | 1.08 | 0.32 | 5.6 |
| Sample No. 12 | Comparative Example | Powder hot extrusion | 287 | 1234 | 0.23 | 0.42 | 0.12 | 0.12 | 0.4 |
| Sample No. 13 | Example | Powder hot extrusion | 513 | 2589 | 0.20 | 0.67 | 0.69 | 0.16 | 1.4 |
| Sample No. 14 | Example | Powder hot extrusion | 1025 | 2897 | 0.35 | 0.53 | 0.92 | 0.22 | 0.7 |
| Sample No. 15 | Comparative Example | Powder hot extrusion | 1602 | 4135 | 0.39 | 0.48 | 0.29 | 0.37 | 4.1 |
| Sample No. 16 | Example | Powder hot extrusion | 724 | 2419 | 0.30 | 0.63 | 0.74 | 0.15 | 1.3 |
| Sample No. 17 | Example | Powder hot extrusion | 1184 | 2815 | 0.42 | 0.56 | 0.85 | 0.20 | 0.8 |
| Sample No. 18 | Comparative Example | Cast extrusion | — | — | — | — | — | — | — |

| | | Powder properties | | | Results of evaluation of molded article | | |
|---|---|---|---|---|---|---|---|
| | | | | | | 0.2% | |
| | | Ca concentration distribution Factor | XRD (MgO) % | XRD (Al—Ca) % | Tensile strength (relative value) — | bearing force (relative value) — | Elongation (relative value) — |
| Sample No. 1 | Comparative Example | 2.8 | 36 | 2 | 1.2 | 1.1 | 0.87 |
| Sample No. 2 | Example | 6.3 | 25 | 3 | 1.5 | 1.9 | 2.5 |
| Sample No. 3 | Example | 10.2 | 18 | 5 | 1.8 | 2.1 | 3.1 |
| Sample No. 4 | Example | 15.6 | 15 | 8 | 2.3 | 2.5 | 3.8 |
| Sample No. 5 | Example | 5.2 | 12 | 11 | 2.7 | 2.9 | 4.5 |
| Sample No. 6 | Example | 5.5 | 11 | 16 | 2.1 | 2.3 | 3.7 |

TABLE 1-continued

| | | | | | | | |
|---|---|---|---|---|---|---|---|
| Sample No. 7 | Example | 5.7 | 8 | 28 | 1.9 | 2.2 | 2.8 |
| Sample No. 8 | Comparative Example | 123 | 6 | 51 | 0.75 | 0.81 | 5.6 |
| Sample No. 9 | Comparative Example | 24.3 | 10 | 12 | 0.54 | 0.69 | 6.3 |
| Sample No. 10 | Comparative Example | 1.3 | 48 | 2 | 3.1 | 3.5 | 0.32 |
| Sample No. 11 | Comparative Example | 79.5 | 9 | 24 | 0.85 | 0.91 | 1.1 |
| Sample No. 12 | Comparative Example | 1.5 | 32 | 6 | 2.9 | 3.1 | 0.45 |
| Sample No. 13 | Example | 9.2 | 21 | 7 | 1.7 | 2.0 | 2.8 |
| Sample No. 14 | Example | 31.2 | 9 | 14 | 2.6 | 2.8 | 4.1 |
| Sample No. 15 | Comparative Example | 245 | 5 | 45 | 0.64 | 0.72 | 5.9 |
| Sample No. 16 | Example | 7.2 | 27 | 4 | 1.8 | 2.2 | 3.2 |
| Sample No. 17 | Example | 47.6 | 15 | 7 | 2.6 | 2.8 | 4.3 |
| Sample No. 18 | Comparative Example | — | — | — | 1 | 1 | 1 |

As is clear from Table 1, the magnesium-based alloy molded articles of Examples excel in a balance of mechanical properties such as tensile strength, 0.2% bearing force, and elongation, demonstrating that these are useful as structures.

On the other hand, the magnesium-based alloy molded articles of Comparative Examples were inferior to the articles of Examples, particularly with respect to mechanical properties.

The calcium atom distribution in a particle cross section was determined for the magnesium-based alloy powders of Examples. The results confirmed segregation of calcium atoms on particle surface.

Evaluation of the flame retardance of the magnesium-based alloy molded articles of Examples revealed that the flame retardance was sufficient, with firing temperatures of 600° C. and higher in the atmosphere.

The entire disclosure of Japanese Patent Application No. 2013-038455, filed Feb. 28, 2013 is expressly incorporated by reference herein.

What is claimed is:

1. A magnesium-based alloy powder comprising a magnesium-based alloy that contains 0.2 mass % to 5 mass % of calcium, and contains nickel and cerium, wherein an amount of each of the nickel and cerium is in the range of 0.1 to 5 mass %, wherein the magnesium-based alloy powder has an average particle diameter of 100 μm to 1,500 μm, wherein the magnesium-based alloy powder has a particle average aspect ratio of 0.5 to 1, wherein the magnesium-based alloy powder has an apparent density of 0.2 g/cm$^3$ to 1.2 g/cm$^3$, wherein a concentration of the calcium on a surface of the particle is two times or more greater than a concentration of the calcium inside the particle in terms of mass ratio, and wherein the mean value of hardness variation index values obtained by dividing the difference of the maximum value and the minimum value of micro Vickers hardnesses taken at 10 measurement points in a particle cross section by the maximum value is 0.3 or less.

2. The magnesium-based alloy powder according to claim 1, wherein the calcium segregates on a surface of each particle of the magnesium-based alloy powder.

3. The magnesium-based alloy powder according to claim 1, wherein the magnesium-based alloy further comprises 2.5 mass % to 12 mass % of aluminum.

4. The magnesium-based alloy powder according to claim 1, wherein the average dendrite arm spacing (DAS) in a crystal structure of the magnesium-based alloy powder is 0.05 μm to 5 μm.

5. The magnesium-based alloy powder according to claim 1, wherein the magnesium-based alloy powder is produced by using high-speed rotary water jet atomization.

* * * * *